US005873490A

United States Patent [19]

Walpole

[11] Patent Number: 5,873,490

[45] Date of Patent: Feb. 23, 1999

[54] FLOWABLE SUBSTANCE DISPENSER

[76] Inventor: Geary A. Walpole, 37 Thackeray Rd., Oakland, N.J. 07436

[21] Appl. No.: 762,560

[22] Filed: Dec. 9, 1996

[51] Int. Cl.[6] ..... B65D 35/28

[52] U.S. Cl. ..... 222/95; 222/105; 222/386

[58] Field of Search ..... 222/95, 105, 325, 222/386, 326; 215/11.3

[56] References Cited

U.S. PATENT DOCUMENTS

| | | | |
|---|---|---|---|
| 3,933,273 | 1/1976 | Cox . | |
| 4,749,106 | 6/1988 | Von Schuckmann et al. | 222/105 X |
| 5,029,198 | 7/1991 | Walpole et al. . | |
| 5,033,631 | 7/1991 | Nightingale . | |
| 5,035,347 | 7/1991 | Trovo . | |
| 5,100,025 | 3/1992 | McGraw . | |
| 5,139,169 | 8/1992 | Boyer | 222/326 X |
| 5,178,300 | 1/1993 | Haviv et al. . | |
| 5,226,563 | 7/1993 | Coggiola | 222/95 |
| 5,356,016 | 10/1994 | Wiedemann . | |
| 5,419,460 | 5/1995 | Herold et al. . | |
| 5,505,336 | 4/1996 | Montgomery et al. . | |

*Primary Examiner*—Gregory L. Huson
*Attorney, Agent, or Firm*—Klauber & Jackson

[57] ABSTRACT

A flowable substance dispenser for use with at least one flexible bag, each bag capable of holding one or more flowable substances, the dispenser comprising a hollow tubular body, adapted to receive the flexible bag, and a plunger assembly. The tubular body includes a proximal end, a distal end, an inner periphery, an outer periphery, one or more longitudinal slots, and at least one transverse exit port disposed near the distal end of the tubular body. The plunger assembly includes a piston adapted to slide within the tubular body, a ring member having an inner periphery adapted to fit around the outer periphery of the tubular body, and a transverse bar attached to the inner periphery of the ring member. The bar is adapted to slide within the one or more slots and is capable of engaging the piston.

36 Claims, 7 Drawing Sheets

FLOWABLE SUBSTANCE DISPENSER

BACKGROUND OF THE INVENTION

1. Field of the Invention

This invention relates to a dispenser used with flexible bags which can be filled with one or more flowable substances, in particular such flowable substances as pastes, toothpastes, dental preparations, gels, putties, glues, caulks, soaps, shampoos, foodstuffs, doughs, and other flowable substances.

2. Description of the Prior Art

Various types of dispensers for flowable substances are known. However, it is desirable to provide a dispenser which uses flexible bags, preferably a "chub" style flexible bag. The chubs are usually relatively thin and flexible and fabricated of plastic or foil laminate material. Chubs are typically sealed on one end in preparation for filling with the desired contents. Typically the end of the flexible bag is sealed by folding or crimping, then stapling or clipping the end of the bag with a clip or staple made of metal, plastic, or other suitable material. The bags are then filled with one or more substances, and sealed on the opposite end in similar fashion. Chubs may also be pre-fabricated with one open end and one contiguous closed end, wherein each chub is filled through the open end, then sealed with a clip or staple. Chubs may be sealed by a heat seal process. The chub is usually sausage-shaped, although other shapes are possible.

When in an unfilled or empty state, the flexible bags occupy minimal space and have minimal weight. Thus, overhead costs related to storage and production floor management can be minimized. Moreover, chubs may be filled in an economical fashion by using automated machinery and mass production methods.

In the toothpaste or dentrifice field, dispensers have been made from metal or plastics. In recent years, at least one manufacturer has produced a toothpaste dispenser capable of delivering dual dentrifice components, such as a paste having baking soda and a gel having hydrogen peroxide, wherein the dispenser and its refill portion are made of a relatively hard plastic. Such devices are somewhat difficult to use because of the force and balance necessary to dispense the contents. For example, users may dispense more gel than paste, or vice versa, if the proper balance is not achieved while attempting to dispense the contents. Furthermore, the dispenser and its refill portion are bulky and, after use and disposal, contribute to increased volumes of solid waste from disposal after use. Typically, when such containers are prepare, shipped and sold as fall containers, the containers may be only half full, when accounting for the unused dead volume inside the container.

Among the objects of the present invention is to provide a dispenser for use with one or more flexible bags, such as a chub, for delivering desired amounts of the contents of the chub or chubs with relative ease.

It is another object to provide a dispenser which includes a dispensing actuation means which can be gripped by a user's hand and/or fingers.

It is yet another object to provide a dispenser which includes a dispensing actuation means which can be gripped by a user's hand and/or fingers.

It is another object to provide a dispenser which is economical to fill.

It is another object to provide a dispenser which is economical to refill.

It is still another object to provide a dispenser which is economical to manufacture.

It is yet another object to provide a dispenser having a reduced number of parts.

It is another object to provide a dispenser which is easy to use.

It is yet another object to provide a dispenser which is well-balanced and ergonomically suited for dispensing one or more flowable substances.

It is a further object to provide a dispenser which is either disposable or refillable.

It is a still further object to provide a dispenser which is capable of standing upright on a stable base.

It is another object to provide a dispenser which is lightweight.

It is yet another object to provide a dispenser which maximizes the usable volume for holding the contents.

SUMMARY OF THE INVENTION

The present invention comprises, in a first embodiment, a flowable substance dispenser for use with at least one flexible bag, where each bag is capable of holding one or more flowable substances. The dispenser comprises a hollow tubular body adapted to receive the flexible bag and a plunger means. The tubular body includes a proximal end, a distal end, an inner periphery, an outer periphery, one or more longitudinal slots, and at least one transverse exit port disposed near the distal end of the tubular body. The plunger means includes a piston adapted to slide within the tubular body, ring means having an inner periphery adapted to fit around the outer periphery of the tubular body, and a transverse bar attached to the inner periphery of the ring means, the bar being adapted to slide within the one or more slots and capable of engaging the piston.

The distal and proximal ends of the hollow tube may each be either open or closed. The slots may extend to the proximal or distal end of the hollow tubular body, either to the edge or to another point on the tubular body. Preferably, the tube has at least one pair of opposing longitudinal slots.

The transverse bar is either fixedly or releasably attached to the ring means. Preferably, the transverse bar releasably engages the piston.

The dispenser further preferably comprises a cap adapted to cover one end, such as the proximal end, of the hollow tubular body. The cap may be fixedly or threadedly attached to the hollow tubular body. Preferably, the piston is adapted to frictionally engage at least a portion of the inner periphery of the hollow tubular body.

The flexible bag may be provided with indicia visible through at least one of the slots, and the indicia may provide a visual cue for aligning the flexible bag within the tubular body.

Each flexible bag preferably further comprises a portion through which the contents may be expelled, such as a pre-formed hole or a perforated or weakened portion. A plurality of perforations or an opening in the bag may define an exit hole portion. The flexible bag may further comprise a peelable cover means disposed over the pre-formed hole or weakened portion or exit hole portion. The peelable cover may be a plastic or metal foil.

The dispenser may further comprise a support member attached to the distal end of the hollow tubular body. Preferably the support member is adapted to receive at least a portion of the flexible bag means. The support member preferably further comprises a tubular support wall having an inner periphery and an outer periphery, and an opening in the support wall. The opening and the exit port are capable of being at least partially aligned.

A spigot means may be attached to the support member. The spigot means may be removably or fixedly or threadedly attached to the support member. The spigot means may further include a piercing means capable of being inserted into the flexible bag. For example, the piercing means may include a pointed end. The spigot means is preferably attached to the hollow tubular wall surrounding the exit port, and the spigot means may be removably, threadedly or fixedly attached to the support member. The spigot means is disposed so as to be in communication with one of the exit ports. A cap may releasably engage the spigot means.

The support may include a baffle means for dividing the interior of the support into first and second portions capable of receiving first and second flexible bags, respectively. Preferably, at least one of the exit ports intersects the first portion, the second portion, and the baffle means.

In a second embodiment, the present invention comprises a dispenser for use with one or more flexible bags containing flowable contents, wherein the dispenser comprises a hollow receptacle means for receiving the one or more flexible bags, a longitudinal slot means disposed in the receptacle means, an exit means disposed in the receptacle means for providing an outlet path for the contents of the flexible bag, and a plunger means for forcing the contents out of the flexible bag. The plunger means includes a piston means disposed within the receptacle means for engaging the one or more flexible bags, a circumferential grip means extending substantially around the outer periphery of the hollow receptacle means and adapted to slide therealong, and a transverse member attached to the grip means and adapted to extend through the slot means and through the interior of the receptacle means, wherein the transverse member is capable of engaging the piston. The movement of the circumferential grip means toward the one or more flexible bags causes the plunger to move toward the bags, thereby causing the bags to compress and eject any flowable contents therein out through the exit means. The dispenser may also include a dispensing end member attached to the hollow receptacle means, where the dispensing end member has an opening in communication with the exit means.

The hollow receptacle means may include an elongated hollow tube having an open proximal end, an open distal end, a cap member disposed over the proximal end, and a dispensing end member disposed over the distal end.

In a third embodiment, the present invention comprises a dispenser, for use with one or more flexible bags containing one or more flowable oral care substances, which includes a hollow tubular body adapted to receive the flexible bags, a plunger adapted to slide within the tubular body, an actuating means, a proximal end member, and a distal end member. The hollow tubular body includes a proximal end, a distal end, an inner periphery, an outer periphery, one or more longitudinal slots, and one or more exit ports disposed near the distal end of the tubular body. The actuating means is adapted to slide within the one or more slots and is capable of engaging the plunger. The actuating means includes a ring member having an inner portion adapted to fit around the tubular body and a transverse support bar fixedly attached to the inner portion of the ring member. The proximal end member is adapted to fit over the proximal end of the hollow tubular body, and the distal end member is adapted to fit over the distal end of the hollow tubular body. The plunger is disposed between the one or more flexible bags and the actuating means. Movement of the actuating means toward the distal end of the hollow tubular body tends to compress the one or more bags and expel their contents through the one or more exit ports. Preferably, the distal end member is further adapted to support the hollow tubular body and the flexible bags in a substantially vertical direction. The plunger is preferably adapted to frictionally engage at least a portion of the inner periphery of the hollow tubular body.

The distal end member may also include one or more exit openings adapted to communicate with at least one of the exit ports. The contents of at least one of the bags are thus capable of flowing through at least one of the exit openings.

The transverse bar may be fixedly attached to the plunger. The flexible bags are preferably provided with indicia visible through at least one of the slots, and preferably have a pre-formed hole and a peelable cover means disposed over the pre-formed hole. The cover means may be a plastic or metal foil having at least one side coated with an appropriate adhesive in a manner which facilitates selective peeling by the user. The flexible bags further preferably comprise indicia, wherein the indicia provides a visual cue for aligning the flexible bag within the tubular body.

A spigot preferably extends from the distal end member and is disposed around at least one of the exit ports. Preferably, the distal end of the spigot is capable of piercing, or being inserted into, one or more of the flexible bags.

The distal end member may further comprise a baffle means for dividing the interior of the distal end member into first and second portions capable of receiving first and second flexible bags, respectively.

In a fourth embodiment, the present invention contemplates a toothpaste dispenser comprising one or more flexible bags capable of containing toothpaste, a hollow tubular body adapted to receive the flexible bags, a base support means for receiving the tubular body and the one or more flexible bags and for supporting the tubular body and the bags in a substantially vertical position, a plunger adapted to slide within the tubular body and disposed on top of the one or more bags, and a ring member.

The hollow tubular body includes two longitudinal slots and an exit port disposed near one end of the tubular body. The base support means includes an exit means for the one or more flowable substances out of the dispenser, wherein the exit means and the exit port are capable of being at least partially aligned. The ring member includes a circumferential portion adapted to longitudinally slide over the outer periphery of the tubular body and a transverse bar extending across the circumferential portion and adapted to slide within the longitudinal slots. The transverse bar is capable of engaging the plunger, and downward movement of the ring member causes the plunger to contact the one or more flexible bags. Thus, the toothpaste in the flexible bags is urged to flow out of the dispenser through the exit port and the exit means.

Preferably, the flexible bags are chubs, which are typically flexible bags sealed at both ends, where one end may be sealed by a metal or plastic clip.

The dispenser also preferably includes a cap adapted to fit on top of the tubular body. Furthermore, the exit means preferably includes an opening in the base support means and a spigot means, which includes a spigot tube and a releasable spigot cover which helps to prevent unwanted flow of the contents out of the one or more flexible bags or chubs.

The dispenser may be formed such that the tubular body releasably engages the base support, and the cap releasably engages the hollow tube.

Thus the present invention provides a dispenser for use with one or more flexible bags, such as a chub, for delivering desired amounts of the contents of the chub or chubs with relative ease. The dispenser includes a dispensing actuation means which can be gripped by a user's hand and/or fingers. The dispenser is easy to use and is well-balanced and ergonomically suited for dispensing one or more flowable substances.

The foregoing and other objects, advantages and features of the invention, and the manner in which the same are accomplished, will become more readily apparent upon the consideration of the following detailed description of the invention taken in conjunction with the accompanying drawings, which illustrate preferred and exemplary embodiments.

DESCRIPTION OF THE PREFERRED EMBODIMENT

Figure 1:
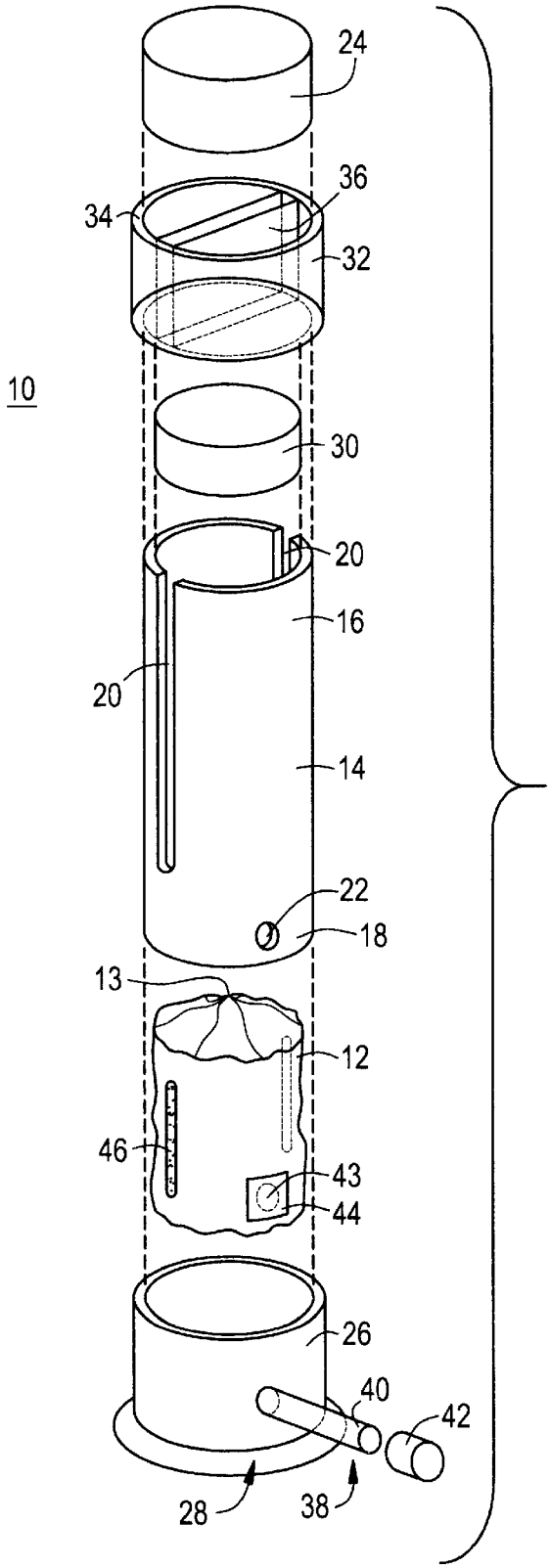
FIG. 1 is an exploded perspective view of one embodiment of the present invention showing two longitudinal slots extending to the edge of the proximal end of the tubular body.

The present invention comprises, in a first embodiment, a flowable substance dispenser for use with at least one flexible bag. Each bag is capable of holding one or more flowable substances. The dispenser comprises at least one flexible bag, a hollow tubular body adapted to receive the flexible bag, and a plunger means. The hollow tubular body includes a proximal end, a distal end, an inner periphery, an outer periphery, one or more longitudinal slots, and at least one transverse exit port disposed near the distal end of the tubular body. More than one exit port may be provided, for example diametrically opposed exit ports or longitudinally spaced exit ports. The plunger means includes a piston adapted to slide within the tubular body, ring means having an inner periphery adapted to fit around the outer periphery of the tubular body, and a transverse bar attached to the inner periphery of the ring means, the bar being adapted to slide within the one or more slots and capable of engaging the piston.

The distal and proximal ends of the hollow tube are preferably open, but one or both ends may be closed.

The slots may extend to the proximal end of the hollow tubular body, or to the distal end of the hollow tubular body. Alternately, the slots may lie within the hollow tubular body without extending to either end. Preferably, the at least two longitudinal slots further comprise at least one pair of opposing longitudinal slots. However, the slots need not be diametrically opposed to one another.

The transverse bar may either be releasably attached or fixedly attached to the ring means. Moreover, the transverse bar releasably engages the piston or is fixedly attached to the piston.

The dispenser may further comprise a cap which is adapted to cover the proximal end of the hollow tubular body, especially if the proximal end is open. The cap may be threadedly attached or fixedly attached to the hollow tubular body.

The piston is preferably adapted to frictionally engage at least a portion of the inner periphery of the hollow tubular body, although engagement with the inner periphery of the hollow tubular body may not be necessary, for example, depending upon the type of flowable substance to be dispensed.

The flexible bag is preferably provided with indicia which is visible through at least one of the slots, wherein the indicia provides a visual cue for aligning the flexible bag within the tubular body.

The flexible bag further comprises a pre-formed hole, or a weakened portion, or a plurality of perforations defining an exit hole portion through which the flowable substance will exit. The flexible bag may further comprise a peelable cover means which is disposed over the pre-formed hole or weakened portion or exit hole portion. The peelable cover means may include a metal foil or plastic swatch having a side provided with a suitable adhesive that permits releasable attachment.

The dispenser may further comprise a support member attached to the distal end of the hollow tubular body. Preferably, the support member is adapted to receive at least a portion of the flexible bag means. The support member may further comprise a tubular support wall having an inner periphery and an outer periphery, and an opening in the support wall, wherein the opening and the exit port are capable of being at least partially aligned. Preferably, the opening and the exit port are capable of being completely aligned to minimize obstructions to the outward flow of substance or substances. However, it may be desirable to partially obstruct the flow as a metering means, for example, depending upon the nature and type of flowable substance to be dispensed.

The dispenser may further comprise a spigot means attached to the support member. The spigot means may be removably attached or fixedly attached to the support member. The spigot means may be threadedly attached to the support member. The spigot means may include a piercing means capable of being inserted into the flexible bag. The piercing means may have a pointed end.

Preferably, the spigot means is attached to the support member. The spigot means may be fixedly or removably attached, and may further be threadedly attached to the support member. Alternately, the spigot means may be attached to the hollow tubular wall surrounding the exit port. The spigot means is disposed in communication with one of the exit ports.

The dispenser may further comprise a cap adapted to releasably engage the spigot means. The cap is adapted to prevent the flow of the substance out of the spigot means. The cap may be threadedly attached to the spigot means, or the cap may be hingedly attached to the spigot means.

The support may further include a baffle means for dividing the interior of the support into first and second portions capable of receiving first and second flexible bags, respectively, in which case at least one of the exit ports intersects the first portion, the second portion, and the baffle means. Additional baffle means may be provided for accommodating additional flexible bags.

In a second embodiment, the present invention comprises a dispenser for use with one or more flexible bags containing flowable contents, wherein the dispenser includes a hollow receptacle means for receiving the one or more flexible bags, a longitudinal slot means disposed in the receptacle means, and an exit means disposed in the receptacle means for providing an outlet path for the contents of the flexible bag, a plunger means for forcing the contents out of the flexible bag. The plunger means includes a piston means disposed within the receptacle means for engaging the one or more flexible bags, a circumferential grip means extending substantially around the outer periphery of the hollow receptacle means and adapted to slide therealong, and a transverse member attached to the grip means and adapted to extend through the slot means and through the interior of the receptacle means, wherein the transverse member is capable of engaging the piston. Movement of the circumferential grip means toward the one or more flexible bags causes the plunger to move toward the bags, thereby causing the bags to compress and eject any flowable contents therein out through the exit means. The dispenser may further comprises a dispensing end member attached to the hollow receptacle means, the dispensing end member having an opening in communication with the exit means.

The hollow receptacle means further comprises an elongated hollow tube having an open proximal end, an open distal end, a cap member disposed over the proximal end, and a dispensing end member disposed over the distal end.

In a third embodiment, the present invention comprises a dispenser for use with one or more flexible bags containing one or more flowable oral care substances. The dispenser comprises a hollow tubular body adapted to receive the flexible bags, a plunger adapted to slide within the tubular body, an actuating means, a proximal end member, and a distal end member. The tubular body includes a proximal end, a distal end, an inner periphery, an outer periphery, one or more longitudinal slots, and one or more exit ports disposed near the distal end of the tubular body. The actuating means is adapted to slide within the one or more slots and capable of engaging the plunger. The actuating means includes a ring member having an inner portion adapted to fit around the tubular body and a transverse support bar fixedly attached to the inner portion of the ring member. The proximal end member is adapted to fit over the proximal end of the hollow tubular body. The distal end member is adapted to fit over the distal end of the hollow tubular body. The plunger is disposed between the one or more flexible bags and the actuating means, such that the movement of the actuating means toward the distal end of the hollow tubular body is capable of compressing the one or more bags and expelling their contents through the one or more exit ports.

The distal end member is preferably adapted to support the hollow tubular body and the flexible bags in a substantially vertical direction. The distal end member further comprises one or more exit openings adapted to communicate with at least one of the exit ports, wherein the contents of at least one of the bags are capable of flowing through at least one of the exit openings.

The transverse bar may additionally be fixedly attached to the plunger.

The flexible bags are preferably provided with indicia visible through at least one of the slots. The flexible bags further preferably comprise indicia, wherein the indicia provides a visual cue for aligning the flexible bag within the tubular body.

Each of the flexible bags may comprise a pre-formed hole, and may further include a peelable cover means disposed over the pre-formed hole. The peelable cover means is preferably a metal foil having an appropriate adhesive backing which permits releasably attachment.

The dispenser may further comprise a spigot extending from the distal end member and disposed around at least one of the exit ports. The distal end of the spigot may additionally be capable of piercing at least one of the flexible bags or be capable of being inserted into the flexible bag. Thus, the spigot may include piercing means. The distal end member may further comprise a baffle means for dividing the interior of the distal end member into first and second portions which are capable of receiving first and second flexible bags, respectively.

The plunger is preferably adapted to frictionally engage at least a portion of the inner periphery of the hollow tubular body.

In a fourth embodiment, the present invention comprises a dispenser for use with one or more flexible bags containing one or more flowable oral care substances. The dispenser includes a hollow tubular body adapted to receive the flexible bags, the tubular body including two longitudinal slots and an exit port disposed near one end of the tubular body. The dispenser also includes a base support means for receiving the tubular body and the one or more flexible bags, and for supporting the tubular body and the bags in a substantially vertical position. The base support means includes an exit means for the one or more flowable substances out of the dispenser. The exit means and the exit port are capable of being at least partially aligned. The dispenser further includes a plunger adapted to slide within the tubular body and disposed on top of the bag or bags, and a ring member which includes a circumferential portion adapted to longitudinally slide over the outer periphery of the tubular body and a transverse bar extending across the circumferential portion and adapted to slide within the longitudinal slots. The transverse bar is capable of engaging the plunger, wherein downward movement of the ring member causes the plunger to contact the one or more flexible bags, and the substances in the flexible bags is urged to flow out of the dispenser through the exit port and the exit means. Preferably, the flexible bags are chubs. A cap is adapted to fit on top of the tubular body.

The exit means may further comprise a spigot means, and the spigot means may include a releasable spigot cover.

Preferably, the tubular body releasably engages the base support, and the cap releasably engages the hollow tube.

With specific reference to the drawings, the embodiment shown in FIG. 1 depicts a flowable substance dispenser 10 for use with a flexible bag or chub 12 containing one or more flowable oral care substances, such as toothpaste. The chub may be sealed at one or more ends by a clip 13 or fastener or other seal such as a heat seal or adhesive other means. The dispenser 10 includes a hollow tubular body 14 adapted to receive the chub 12. The tubular body 14 is open at both its proximal end 16 and its distal end 18. The tubular body 14 includes two longitudinal slots 20, each extending to the proximal edge of the tubular body 14. An exit port 22 is disposed near the distal end 18 of the tubular body 14. A cap 24 is adapted to fit on top of the tubular body 14.

The dispenser 10 also includes a base support means on base support member 26 for receiving the tubular body 14 and the chub 12. The base support means 26 preferably supports the tubular body 14 and the chub 12 in a substantially vertical orientation. The base support means 26 includes an exit means 28 for providing an outlet path for the flowable substances. The exit means 28 and the exit port 28 are aligned to allow the flow of the substance contained in the chub to pass out of the chub 12, through the exit means 28 and exit port 22, and out of the dispenser 10.

The dispenser 10 further includes a plunger 30 adapted to slide within the tubular body 14. The plunger 30 is disposed on top of the chub 12. A ring member 32 includes a circumferential portion 34 adapted to longitudinally slide over the outer periphery of the tubular body 14 and a transverse portion 36 extending across the circumferential portion 34 and adapted to slide within the longitudinal slots 20. The transverse portion 36 thus engages the plunger 30, so that downward movement of the ring member 32 causes the plunger 30 to contact the chub 12. The downward pressure on the chub 12 results in the substances in the chub 12 being urged to flow out of the dispenser 10 through the exit port 22 and the exit means 28. The exit means 28 preferably includes an opening in the base support member 26, a spigot means 38, and the spigot means includes a spigot tube 40 and a spigot cap or cover 42.

Preferably, the tubular body 14 releasably engages the base support 26, and the cap 24 releasably engages the hollow tube 14.

The chub 12 preferably has a pre-formed hole 43 covered by a peelable cover 44 such as a metal foil or plastic strip having a suitable adhesive on one side. Instead of a pre-formed hole, the chub 12 may have a weakened portion or line of weakness or pre-cut slits which enable a user to easily puncture or create an opening in that part of the chub 12 while allowing the rest of the chub 12 to remain intact. The chub 12 further preferably has one or more surface indicia 46 such as the alignment lines shown in FIG. 1. The chub 12 may inserted into the tubular body 14 such that the surface indicia 46 is aligned with one or more longitudinal slots 20 and visible to the user therethrough. The alignment lines or surface indicia 46 provide a means for aligning the pre-formed hole 43 or weakened portion of the chub with the exit port 22 and/or exit means 28. The alignment lines 46 and slots 20 also provide a means for detecting the amount of substance occupying the chub. Thus, a refill chub may replace a used or expended chub. Chub refills, and the associated packaging, may be very economically.

The dispenser 10 may be constructed so as to be at least partially disassembled by the user. Thus, a user could slidably insert the tubular body 14 into the base support member 26 so that the exit port 22 is aligned with the exit means 28. After removing a foil cover 44 or the like and/or forming a hole in a filled or partially filled chub 12, the chub 12 is inserted into the tubular body 14 while aligning the hole in the chub 12 with the exit port 22. If the chub 12 is provided with alignment lines 46 or other surface indicia, alignment with the exit port 22 may be accomplished by aligning the indicia 46 with one or more of the longitudinal slots 20. A plunger 30 is inserted into the tubular body 14 over the chub 12. The ring member 32 is slid over the tubular body 14 as the transverse portion 36 is positioned over and slid into the longitudinal slots 20. A cap 24 may be attached to the top of the tubular body 14. The cap 24 may be adapted to be slid onto the tubular body 14, and further may be adapted to frictionally fit onto the tubular body 14. Alternately, the cap 24 may attach to the tubular body 14 by snap fit, or the cap 24 and tubular body 14 may be adapted for threaded engagement. Preferably, the spigot 40 is fixedly attached to the base support member 26. Thus, the dispenser 10 may be disassembled by the user for refill or cleaning or other maintenance or repair.

Alternately, the hollow tube 14 may be fixedly attached to the base support member 26, while the plunger 30, ring member 32 and cap 24 may be removable. Furthermore, the dispenser 10 may be constructed so that the distal end 18 of the hollow tube 14 is fixedly attached to the base support member 26 and the cap 24 is fixedly attached to the proximal end 16 of the hollow tube 14, wherein a filled chub 12, plunger 30 and ring member 32 lie within the tubular body 14 between the base support member 26 and cap 24. Thus the dispenser 10 may be constructed to be disposable, especially if refill or maintenance are of minimal concern.

In use, the dispenser 10 is placed on a substantially horizontal surface or other suitable support surface or object, such as the hand. If a spigot cap or spigot cover 42 is provided, the cap or cover 42 is removed or disengaged from the exterior mouth of the spigot 40. The ring member 32 is gripped by the user, preferably by the user's thumb and one or more fingers, and a downward force is exerted on the ring member 32. The ring member 32 drives the plunger 30 against the chub 12, and the contents of the chub 12 are forced out, through the exit port 22 and exit means 28, thereby leaving the dispenser 10.

Figure 2:
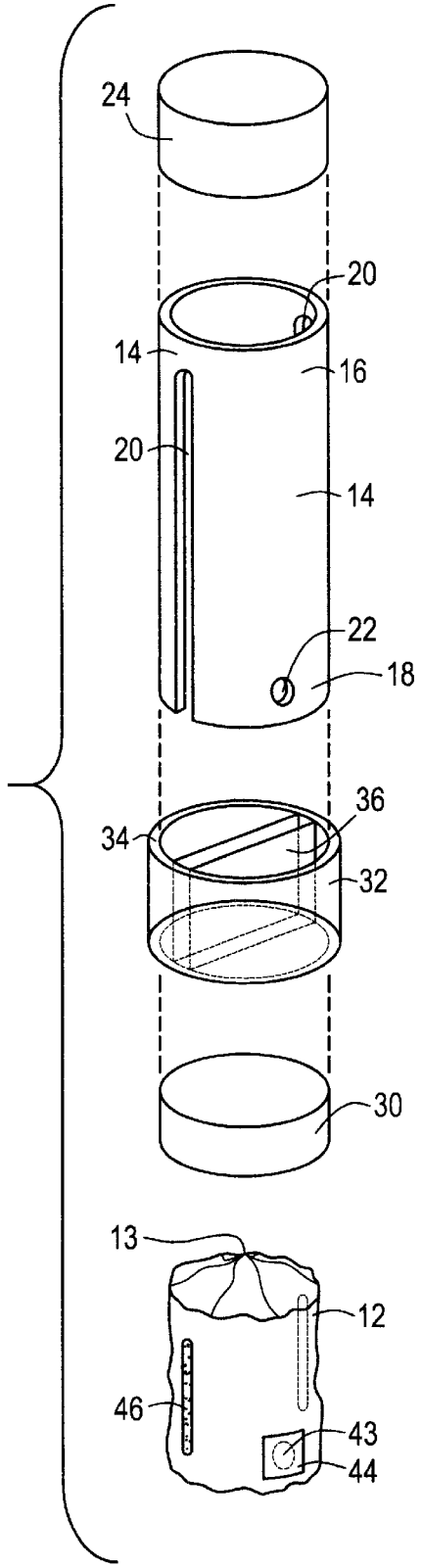
FIG. 2 is an exploded perspective view of another embodiment of the present invention showing two longitudinal slots extending to the edge of the distal end of the tubular body.

The embodiment shown in FIG. 2 illustrates two longitudinal slots, each extending to the distal edge of the tubular body 14.

Figure 3:
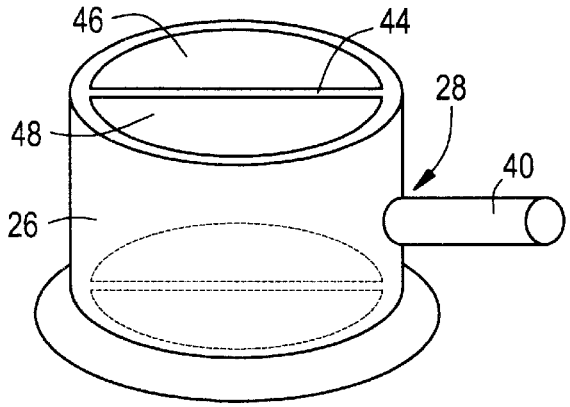
FIG. 3 is a perspective view of a base support having a baffle means.
Figure 4:
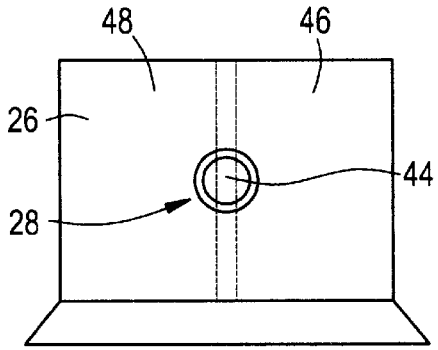
FIG. 4 is a side elevational view of the embodiment of FIG. 3 showing the exit means in communication with first and second portions defined by the baffle means.
Figure 5:
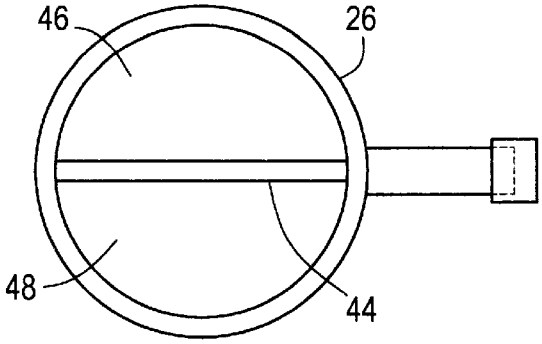
FIG. 5 is a is a top plan view of the embodiment of FIG. 3.
Figure 5A:
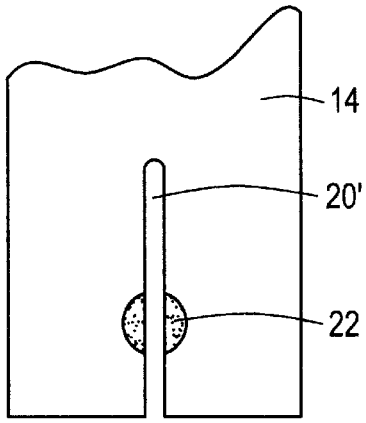
FIG. 5A is a partial side elevational view of an embodiment of a tubular body adapted to fit over the baffle means of FIG. 3.

FIGS. 3–5 illustrate a base support member 26 which includes a baffle 44. The baffle 44 divides the interior of the support member 26 into first and second portions 46,48 capable of receiving first and second flexible bags or chubs 12, respectively. FIG. 5A shows a tubular body 14 having a second pair of longitudinal slots 20' adapted to allow the tubular body 14 to slide over and engage the baffle 44. The exit port 22 intersects the first portion 46, the second portion 48, and the baffle means 44, such that the contents of both of the chubs may pass through the exit port 22. In such a configuration, the slots 20 may be aligned with the exit port 20. Furthermore, the plunger 30 may possess a recess on its bottom surface or face, which contacts the chub or chubs, wherein the recess accommodates the baffle 44 to allow more complete ejection of the contents.

Figure 6:
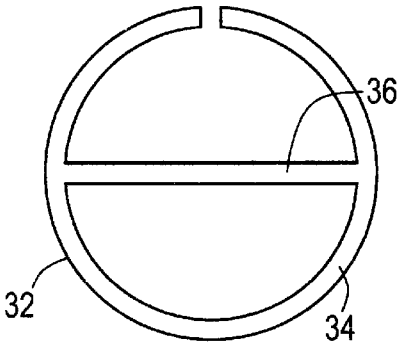
FIG. 6 is a top plan view of an embodiment of a ring member having partial circumferential closure.

FIG. 6 illustrates an alternate embodiment of the ring member 32. The circumferential portion 34 is not adapted to extend entirely around the circumference of the outer periphery of the tubular body 14. The transverse portion 36 shown in FIG. 6 extends diametrically across the ring member 32.

Figure 7:
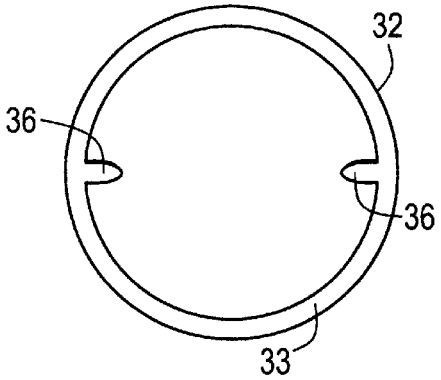
FIG. 7 is a top plan view of an embodiment of a ring member having a transverse portion which extends partially between a circumferential portion.

FIG. 7 illustrates another embodiment of the ring member 32. The circumferential portion 33 is adapted to extend entirely around the circumference of the outer periphery of the tubular body, although the transverse portion 36 extends only partially radially inwardly. The transverse portion 36 is adapted to slide within the longitudinal slots 20.

Figure 8:
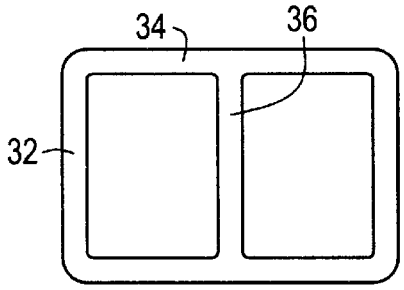
FIG. 8 is a top plan view of an embodiment of a ring member having a quadrilateral cross-section.
Figure 10:
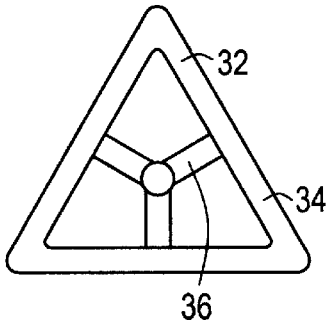
FIG. 10 is a top plan view of an embodiment of a ring member having a triangular cross-section and a three-pronged transverse portion.
Figure 9:
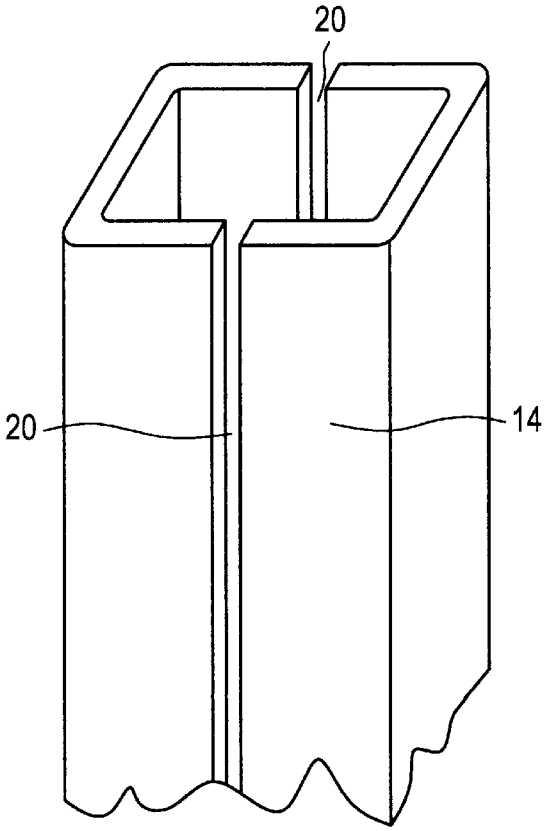
FIG. 9 is a partial side elevational view of an embodiment of a tubular body having a quadrilateral cross-section and adapted to accommodate the ring member of FIG. 8.
Figure 11:
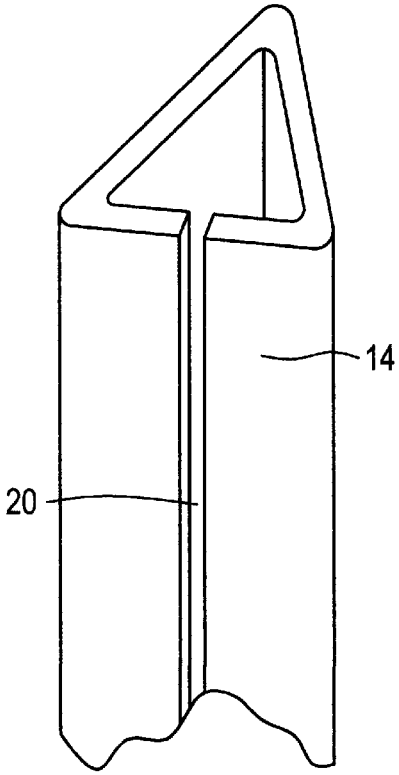
FIG. 11 is a partial side elevational view of an embodiment of a tubular body having a triangular cross-section and adapted to accommodate the ring member of FIG. 10.
Figure 12:
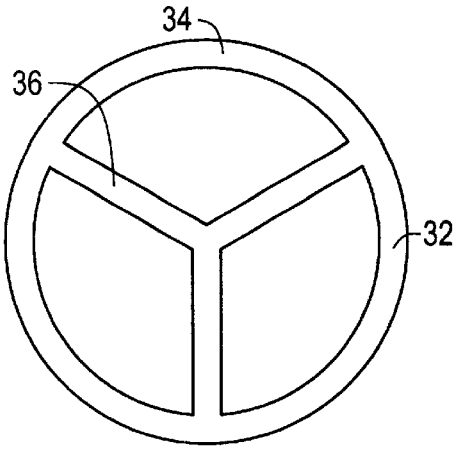
FIG. 12 is a top plan view of an embodiment of a ring member having a circular cross-section and a three-pronged transverse portion.
Figure 13:
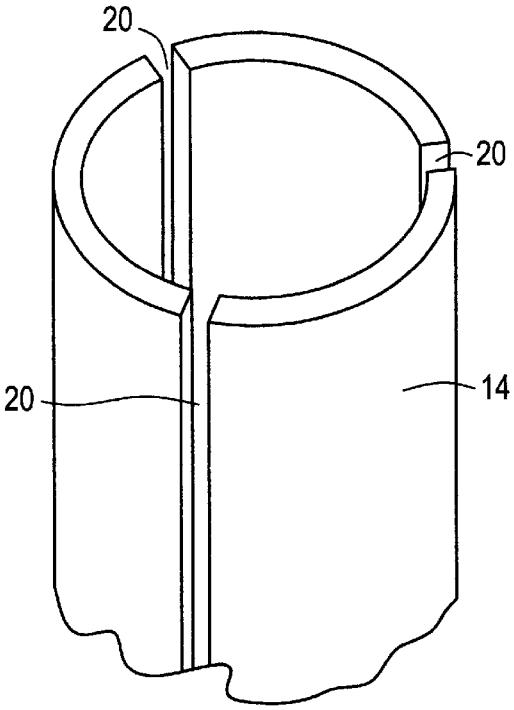
FIG. 13 is a partial side elevational view of an embodiment of a tubular body having a circular cross-section and adapted to accommodate the ring member of FIG. 10.

FIGS. 8 and 9 illustrate another embodiment of a ring member 32 and tubular body 14, respectively, having a generally square, rectangular or quadrilateral cross-section. FIGS. 10 and 11 illustrate yet another embodiment of a ring member 32 and tubular body 14, respectively, having a generally triangular cross-section. The three sections of the transverse portion 36 fit within the three longitudinal slots 20 of the triangular tubular body 14. FIGS. 12 and 13 illustrate still another embodiment of a ring member 32 and tubular body 14, respectively, having a generally circular cross-section, wherein the three sections of the transverse portion 36 fit within the three longitudinal slots 20 of the circular tubular body 14. The transverse portion 36 may also be in the form of a cross shape or X-shape, particularly if the tubular body 14 has a generally circular or quadrilateral cross-section, with corresponding slots 20 in the tubular body 14. Various other shapes and configurations, such as an oval or hexagonal cross-section or others, are also contemplated. It should be understood that the respective plunger 30 is shaped or formed to fit within its respective tubular body 14. Furthermore, the plunger 30 may be disk-like, having a relatively small height or depth, or cylinder-like, having a relatively large height or depth, as compared to its effective diameter.

Figure 14:
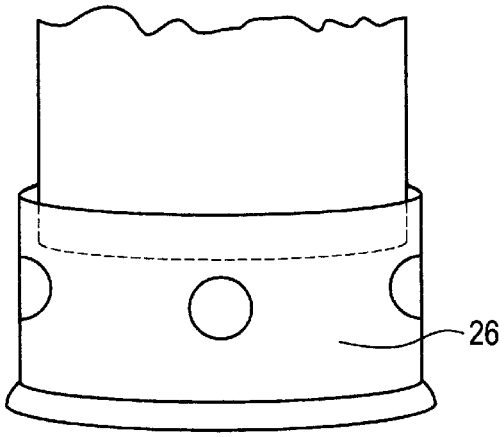
FIG. 14 is a partial side elevational view of an embodiment of a base support member having multiple exit holes.

FIG. 14 illustrates a base support member 26 wherein the exit means 28 includes more than one opening with more than one exit port.

In general, the exit port, or ports 22, are preferably located at or near the distal end 18 of the tubular body 14 to promote a more complete ejection of the contents of the chub 12.

Figure 15:
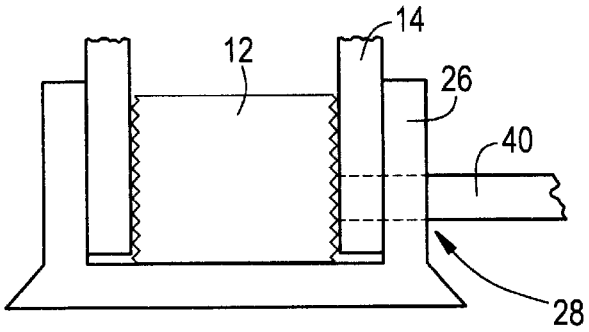
FIG. 15 is a partial side elevational cutaway view of an embodiment of the present invention showing a tubular body with an open end inserted substantially fully into a base support member, wherein the exit port in the tubular body is aligned with the opening and spigot of the base support.
Figure 16:
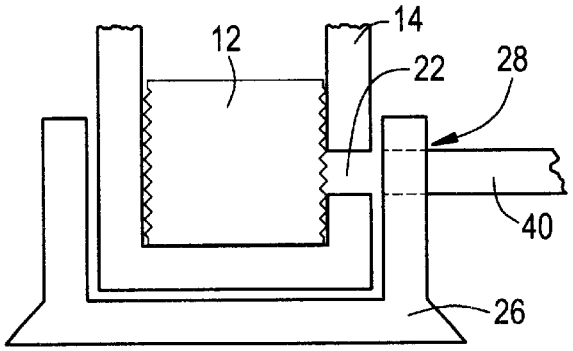
FIG. 16 is a partial side elevational cutaway view of an embodiment of the present invention showing a tubular body with a closed end inserted into a base support member, wherein the exit port in the tubular body is aligned with the opening and spigot of the base support.

Preferably the tubular body 14 fits within the base support member 26 such that the distal edge of the tubular body 14 contacts, or is in close proximity to, an opposing surface of the base support member 26. FIG. 15 illustrates one possible embodiment with a tubular body 14 having an open distal end. FIG. 16 illustrates a similar embodiment which includes a tubular body 14 having a closed distal end.

Figure 17:
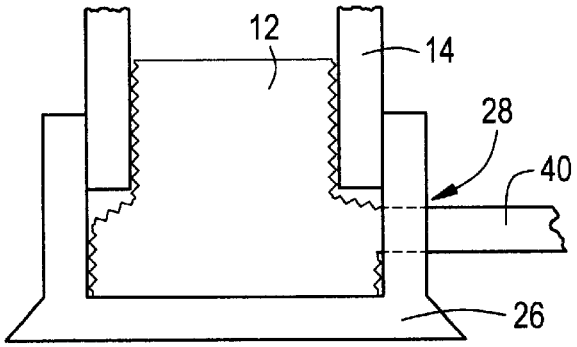
FIG. 17 is a partial side elevational cutaway view of an embodiment of the present invention showing a tubular body with an open end which is partially inserted into a base support member, wherein the contents of the flexible bag may exit through the opening and spigot of the base support without passing through the tubular body.

Another embodiment shown in FIG. 17 shows a tubular body 12 without an exit port, where the tubular body 14 does not extend to an opposing supporting surface of the base support member 26. The contents of the chub 12 pass through the exit means 28 of the base member 26 without passing through the tubular body 14.

Figure 18:
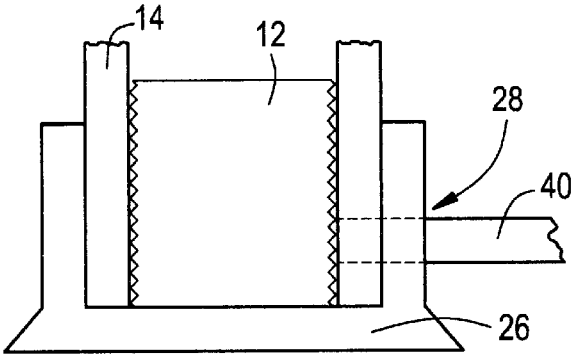
FIG. 18 is a partial side elevational cutaway view of an embodiment of the present invention showing a tubular body with an open end inserted into a base support member, wherein a spigot extends through both the exit port in the tubular body and the opening in the base support.

The spigot in the embodiment of FIG. 18 extends from outside the base support member 26, through the base member, and through the exit port of the tubular body. This configuration is preferable if the tubular body 14 is fixedly attached to the base support member 26.

Figure 19:
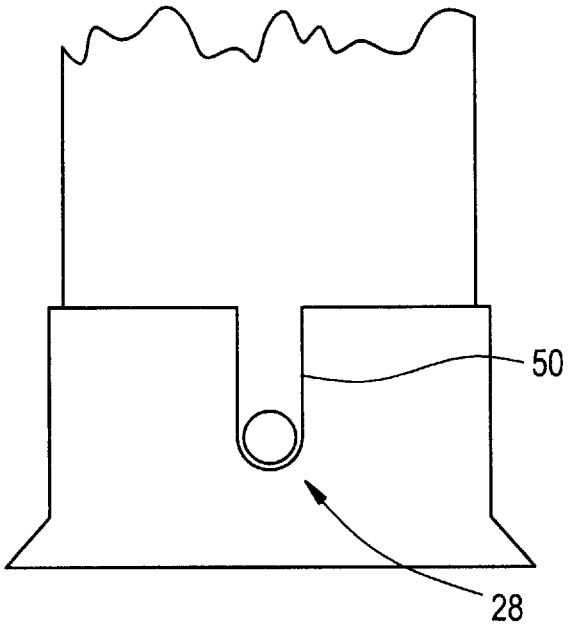
FIG. 19 is a partial side elevational cutaway view of an embodiment of the present invention showing a spigot extending from the exit port in the tubular body, wherein the base support is provided with a slot opening.
Figure 20:
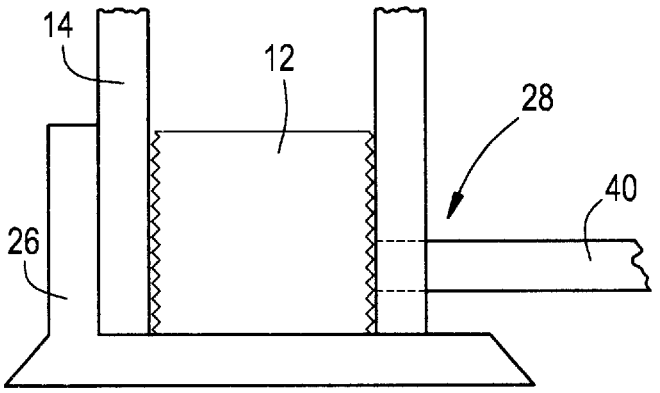
FIG. 20 is a partial side elevational cutaway view of the embodiment of FIG. 19.

The base support member 26 shown in the embodiment of FIGS. 19–20 comprises an exit means 28 which includes an open ended slot 50, which is adapted to coincide with at least a portion of the exit port 22, and a spigot 40 which engages the hollow tubular body 14.

Figure 21:
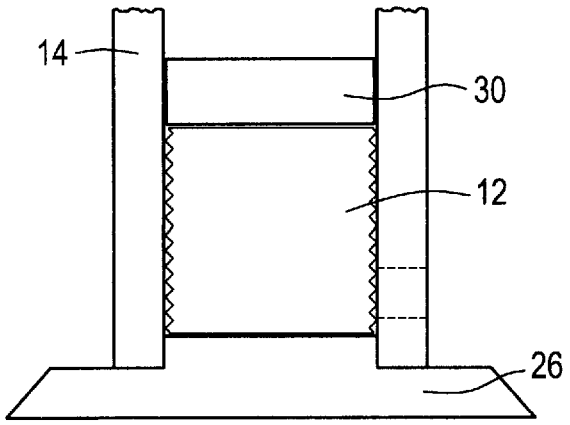
FIG. 21 is a partial side elevational cutaway view of an embodiment of a hollow tubular body adapted to fit over the base support member.

In general, the hollow tubular body 14 preferably fits within the base support member 26. The stroke of the plunger 30 is thus maximized, enabling a more complete discharge of the contents of the chub 12. However, the hollow tubular body 14 may instead be adapted to fit over the base support member 28, as shown in FIG. 21.

Figure 22:
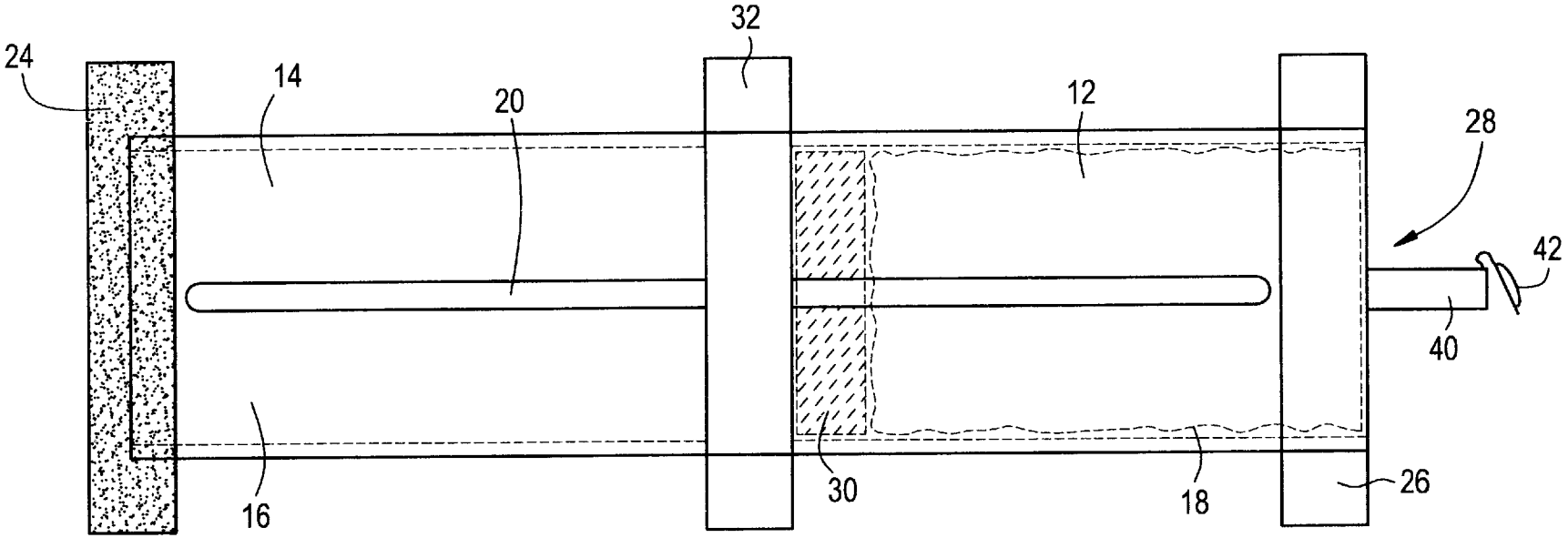
FIG. 22 is an alternate embodiment of the present invention.

FIG. 22 shows an alternate embodiment of the present invention wherein the exit means 28 longitudinally intersects with a transverse surface at a distal end of the dispenser 10. The tubular body 14 is shown having an open end, although a closed end with an exit port 22 in its closed end may be used. An exit means 28 is provided on the base support member 26 on the distal surface which faces longitudinally outward. The exit opening 28 may be disposed at the center along the longitudinal axis of the dispenser 10, or at some other location. More than one exit opening 28 may be provided.

The longitudinal slots 20 shown in FIG. 22 extend to neither the proximal end 16 nor the distal end 18, but are confined to the interior portion of the tubular body 14 therebetween.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

I claim:

1. A flowable substance dispenser for use with at least one flexible bag, each bag capable of holding one or more flowable substances, said dispenser comprising:

a hollow tubular body adapted to receive said flexible bag, said tubular body including:

a proximal end;

a distal end;
an inner periphery;
an outer periphery;
one or more longitudinal slots, and
at least one transverse exit port disposed near the distal end of said tubular body; and a plunger means including:
a piston adapted to slide within said tubular body,
ring means having an inner periphery adapted to fit around the outer periphery of said tubular body, and
a transverse bar attached to the inner periphery of said ring means, said bar being adapted to slide within said one or more slots and capable of engaging said piston.

2. The dispenser according to claim 1 wherein said transverse bar is attached to said piston.

3. The dispenser according to claim 1 further comprising a cap adapted to cover the proximal end of said hollow tubular body.

4. The dispenser according to claim 1 wherein said piston is adapted to frictionally engage at least a portion of the inner periphery of said hollow tubular body.

5. The dispenser according to claim 1 wherein said flexible bag is provided with indicia visible through at least one of said slots.

6. The dispenser according to claim 1 wherein said flexible bag further comprises an exit hole portion.

7. The dispenser according to claim 6 wherein said flexible bag further comprises a peelable cover means disposed over said exit hole portion.

8. The dispenser according to claim 1 further comprising a support member attached to the distal end of said hollow tubular body wherein said suport member is adapted to receive at least a portion of said flexible bag means.

9. The dispenser according to claim 8 wherein said support member further comprises:

a tubular support wall having an inner periphery and an outer periphery; and an opening in said support wall;

wherein said opening and said exit port are capable of being at least partially aligned.

10. The dispenser according to claim 8 further comprising a spigot means attached to said support member.

11. The dispenser according to claim 10 wherein said spigot means further comprises a piercing means capable of being inserted into said flexible bag.

12. The dispenser according to claim 1 further comprising a spigot means attached to said hollow tubular wall surrounding said exit port.

13. The dispenser according to claim 10 wherein said spigot means is disposed in communication with one of said exit ports.

14. The dispenser according to claim 10 further comprising a cap adapted to releasably engage said spigot means.

15. The dispenser according to claim 8 wherein said support member further comprises a baffle means for dividing the interior of said support member into first and second portions capable of receiving first and second flexible bags, respectively.

16. The dispenser according to claim 15 wherein at least one of said exit ports intersects said first portion, said second portion, and said baffle means.

17. A dispenser for use with one or more flexible bags containing flowable contents, said dispenser comprising:

a hollow receptacle means for receiving the one or more flexible bags;

a longitudinal slot means disposed in said receptacle means;

an exit means disposed in said receptacle means for providing an outlet path for the contents of the flexible bag; and a plunger means for forcing the contents out of the flexible bag, said plunger means including:
a piston means disposed within said receptacle means for engaging said one or more flexible bags;
a circumferential grip means extending substantially around the outer periphery of said hollow receptacle means and adapted to slide therealong;
a transverse member attached to said grip means and adapted to extend through said slot means and through the interior of said receptacle means, wherein said transverse member is capable of engaging said piston;

wherein movement of said circumferential grip means toward said one or more flexible bags causes said plunger to move toward said bags, thereby causing said bags to compress and eject any flowable contents therein out through said exit means.

18. The dispenser according to claim 17 further comprising a dispensing end member attached to said hollow receptacle means, said dispensing end member having an opening in communication with said exit means.

19. The dispenser according to claim 17 wherein said hollow receptacle means further comprises an elongated hollow tube having:

an open proximal end;

an open distal end;

a cap member disposed over said proximal end; and a dispensing end member disposed over said distal end.

20. A dispenser, for use with one or more flexible bags containing one or more flowable oral care substances, comprising:

a hollow tubular body adapted to receive said flexible bags, said tubular body including:
a proximal end,
a distal end,
an inner periphery,
an outer periphery,
one or more longitudinal slots, and
one or more exit ports disposed near the distal end of said tubular body;

a plunger adapted to slide within said tubular body;

an actuating means adapted to slide within said one or more slots and capable of engaging said plunger, said actuating means including:
a ring member having an inner portion adapted to fit around said tubular body, and
a transverse support bar fixedly attached to the inner portion of said ring member;

a proximal end member adapted to fit over the proximal end of said hollow tubular body; and a distal end member adapted to fit over the distal end of said hollow tubular body wherein said plunger is disposed between said one or more flexible bags and said actuating means;

wherein movement of said actuating means toward the distal end of said hollow tubular body is capable of compressing said one or more bags and expelling their contents through said one or more exit ports.

21. The dispenser according to claim 20 wherein said distal end member is further adapted to support said hollow tubular body and said flexible bags in a substantially vertical direction.

22. The dispenser according to claim 20 wherein said distal end member further comprises one or more exit openings adapted to communicate with at least one of said exit ports, and wherein the contents of at least one of said bags are capable of flowing through at least one of said exit openings.

23. The dispenser according to claim 20 wherein said at least one of said flexible bags is provided with indicia visible through at least one of said slots.

24. The dispenser according to claim 20 wherein each of said flexible bags further comprises a pre-formed hole.

25. The dispenser according to claim 24 wherein said flexible bag further comprises a peelable cover means disposed over said pre-formed hole.

26. The dispenser according to claim 20 further comprising a spigot extending from said distal end member and disposed around at least one of said exit ports.

27. The dispenser according to claim 20 wherein said distal end member further comprises a baffle means for dividing the interior of said distal end member into first and second portions capable of receiving first and second flexible bags, respectively.

28. The dispenser according to claim 20 wherein said plunger is adapted to frictionally engage at least a portion of the inner periphery of said hollow tubular body.

29. The dispenser according to claim 26 wherein said spigot further comprises a piercing means capable of being inserted into said flexible bag.

30. A toothpaste dispenser comprising:

one or more flexible bags capable of containing toothpaste;

a hollow tubular body adapted to receive said flexible bags, said tubular body including:

two longitudinal slots, and an exit port disposed near one end of said tubular body;

a base support means for receiving said tubular body and said one or more flexible bags, and for supporting said tubular body and said bags in a substantially vertical position, said base support means including an exit means for the one or more flowable substances out of said dispenser;

wherein said exit means and said exit port are capable of being at least partially aligned;

a plunger adapted to slide within said tubular body and disposed on top of said one or more bags; and a ring member including:

a circumferential portion adapted to longitudinally slide over the outer periphery of said tubular body; and a transverse bar extending across the circumferential portion and adapted to slide within said longitudinal slots;

wherein said transverse bar is capable of engaging said plunger;

wherein downward movement of said ring member causes said plunger to contact said one or more flexible bags; and wherein the toothpaste in said flexible bags is urged to flow out of said dispenser through said exit port and said exit means.

31. The dispenser according to claim 30 wherein said flexible bags further comprise chubs.

32. The dispenser according to claim 30 further comprising a cap adapted to fit on top of said tubular body.

33. The dispenser according to claim 30 wherein said exit means further comprises an opening in the base support means and a spigot means.

34. The dispenser according to claim 33 wherein said spigot means further comprises a releasable spigot cover.

35. The dispenser according to claim 30 wherein said tubular body releasably engages said base support.

36. The dispenser according to claim 30 wherein said cap releasably engages said hollow tube.

* * * * *